US011215028B2

(12) United States Patent
Palmer et al.

(10) Patent No.: US 11,215,028 B2
(45) Date of Patent: Jan. 4, 2022

(54) LOCKING BACKPRESSURE VALVE

(71) Applicants: Larry Thomas Palmer, Spring, TX (US); Erik Van Steveninck, Houston, TX (US); Erik Vilhelm Nordenstam, The Woodlands, TX (US); Eric Anders Erickson, Bozeman, MT (US); Scott Bigrigg, Canonsburg, PA (US)

(72) Inventors: Larry Thomas Palmer, Spring, TX (US); Erik Van Steveninck, Houston, TX (US); Erik Vilhelm Nordenstam, The Woodlands, TX (US); Eric Anders Erickson, Bozeman, MT (US); Scott Bigrigg, Canonsburg, PA (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/889,928

(22) Filed: Jun. 2, 2020

(65) Prior Publication Data

US 2021/0372228 A1 Dec. 2, 2021

(51) Int. Cl.
*E21B 34/10* (2006.01)
*E21B 34/14* (2006.01)

(52) U.S. Cl.
CPC ..... *E21B 34/102* (2013.01); *E21B 34/14* (2013.01); *E21B 2200/05* (2020.05)

(58) Field of Classification Search
CPC .... E21B 34/102; E21B 34/14; E21B 2200/05; E21B 34/142
See application file for complete search history.

(56) References Cited

U.S. PATENT DOCUMENTS 3,289,693 A 12/1966 Scaramucci
3,376,935 A 4/1968 Baker
3,951,338 A 4/1976 Genna
(Continued)

FOREIGN PATENT DOCUMENTS

CN 103410491 A 11/2013
CN 110173233 A 8/2019
(Continued)

OTHER PUBLICATIONS

International Search Report and Written Opinion for International Application No. PCT/US2019/026878; International Filing Date Apr. 11, 2019; dated Jul. 26, 2019 (pp. 1-8).
(Continued)

*Primary Examiner* — Michael R Wills, III
(74) *Attorney, Agent, or Firm* — Cantor Colburn LLP

(57) ABSTRACT

A downhole tool includes a tubular having an outer surface and an inner surface defining a flowbore having a longitudinal axis. A backpressure valve is arranged in the flowbore. The backpressure valve includes a flapper valve including a first side and an opposing second side pivotally mounted to the inner surface to selectively extend across the flowbore and a locking system including a spring clip mounted to the inner surface. The flapper valve is pivotable between a first position, wherein the flapper valve is free to pivot relative to the inner surface, and a second position, wherein the flapper valve is pivoted away from the flowbore and locked open by the spring clip such that the first side forms part of the flowbore.

14 Claims, 4 Drawing Sheets

(56) References Cited

U.S. PATENT DOCUMENTS

| | | | | |
|---|---|---|---|---|
| 3,958,633 | A | 5/1976 | Britch et al. | |
| 4,033,429 | A | 7/1977 | Farr | |
| 4,100,969 | A | 7/1978 | Randermann, Jr. | |
| 4,220,206 | A * | 9/1980 | Van Winkle | E21B 34/063 166/317 |
| 4,393,930 | A | 7/1983 | Ross et al. | |
| 4,407,329 | A | 10/1983 | Huebsch et al. | |
| 4,474,241 | A | 10/1984 | Freeman | |
| 4,566,541 | A | 1/1986 | Moussy et al. | |
| 4,597,449 | A | 7/1986 | Keeney | |
| 4,676,307 | A | 6/1987 | Pringle | |
| 4,729,432 | A | 3/1988 | Helms | |
| 4,782,895 | A | 11/1988 | Jacob et al. | |
| 5,022,427 | A | 6/1991 | Churchman et al. | |
| 5,159,981 | A | 11/1992 | Le | |
| 5,496,044 | A | 3/1996 | Beall et al. | |
| 6,260,850 | B1 | 7/2001 | Beall et al. | |
| 6,446,665 | B2 * | 9/2002 | Coscarella | F16K 15/03 137/409 |
| 6,547,007 | B2 * | 4/2003 | Szarka | E21B 21/10 166/317 |
| 6,568,470 | B2 | 5/2003 | Goodson, Jr. et al. | |
| 6,957,703 | B2 | 10/2005 | Trott et al. | |
| 7,063,156 | B2 | 6/2006 | Patel et al. | |
| 7,299,880 | B2 * | 11/2007 | Logiudice | E21B 21/103 166/381 |
| 7,360,600 | B2 * | 4/2008 | MacDougall | E21B 34/102 166/332.8 |
| 7,665,528 | B2 * | 2/2010 | Ross | E21B 34/103 166/373 |
| 8,607,811 | B2 | 12/2013 | Korkmaz | |
| 8,893,796 | B2 * | 11/2014 | Conner | E21B 21/10 166/323 |
| 8,955,543 | B2 | 2/2015 | Groesbeck et al. | |
| 9,163,479 | B2 * | 10/2015 | Rogers | E21B 34/066 |
| 10,619,448 | B1 | 4/2020 | Watson et al. | |
| 2001/0023706 | A1 | 9/2001 | Coscarella | |
| 2003/0121665 | A1 | 7/2003 | Trott | |
| 2004/0060704 | A1 | 4/2004 | Layton et al. | |
| 2007/0137869 | A1 | 6/2007 | MacDougall et al. | |
| 2010/0139923 | A1 | 6/2010 | Biddick | |
| 2010/0212907 | A1 | 8/2010 | Frazier | |
| 2011/0088908 | A1 | 4/2011 | Xu | |
| 2011/0174505 | A1 | 7/2011 | Gill et al. | |
| 2011/0290344 | A1 | 12/2011 | Groesbeck et al. | |
| 2012/0305257 | A1 | 12/2012 | Conner et al. | |
| 2012/0321446 | A1 | 12/2012 | Blewett et al. | |
| 2014/0020904 | A1 | 1/2014 | Hill, Jr. | |
| 2015/0136404 | A1 | 5/2015 | Groesbeck et al. | |
| 2015/0211333 | A1 | 7/2015 | Vick, Jr. et al. | |
| 2016/0138365 | A1 | 5/2016 | Vick, Jr. et al. | |
| 2016/0138368 | A1 | 5/2016 | Girola | |
| 2016/0230503 | A1 | 8/2016 | Holmberg et al. | |
| 2016/0281465 | A1 | 9/2016 | Grayson et al. | |
| 2016/0341002 | A1 * | 11/2016 | McKitrick, III | E21B 34/14 |
| 2017/0175488 | A1 | 6/2017 | Lisowski et al. | |
| 2017/0370186 | A1 * | 12/2017 | Stair | E21B 34/102 |
| 2018/0058177 | A1 | 3/2018 | Bigrigg et al. | |
| 2018/0209246 | A1 | 7/2018 | Miller et al. | |
| 2018/0334833 | A1 | 11/2018 | Brewer | |
| 2018/0334883 | A1 | 11/2018 | Williamson | |
| 2018/0347301 | A1 | 12/2018 | Hilliard et al. | |
| 2019/0003286 | A1 | 1/2019 | Bigrigg et al. | |
| 2019/0331235 | A1 | 10/2019 | Prather et al. | |
| 2019/0338620 | A1 | 11/2019 | Burris et al. | |
| 2020/0190941 | A1 | 6/2020 | Watson et al. | |

FOREIGN PATENT DOCUMENTS

| | | | |
|---|---|---|---|
| EP | 2535504 | A1 | 12/2012 |
| EP | 3561220 | A1 | 10/2019 |
| WO | 2004031534 | A1 | 4/2004 |
| WO | 2006024811 | A1 | 3/2006 |
| WO | 2007073401 | A1 | 6/2007 |
| WO | 2007125335 | A1 | 11/2007 |
| WO | 2017052556 | A1 | 3/2017 |

OTHER PUBLICATIONS

International Search Report and Written Opinion for International Application No. PCT/US2021/034166; International Filing Date May 26, 2021; dated Aug. 27, 2021 (pp. 1-11).

International Search Report and Written Opinion for International Application No. PCT/US2021/034167; International Filing Date May 26, 2021; dated Sep. 14, 2021 (pp. 1-10).

International Search Report and Written Opinion for International Application No. PCT/US2021/034168; International Filing Date May 26, 2021; dated Sep. 3, 2021 (pp. 1-11).

International Search Report and Written Opinion for International Application No. PCT/US2021/034170; International Filing Date May 26, 2021; dated Aug. 27, 2021 (pp. 1-11).

International Search Report and Written Opinion for International Application No. PCT/US2021/034173; International Filing Date May 26, 2021; dated Sep. 16, 2021 (pp. 1-10).

International Search Report and Written Opinion for International Application No. PCT/US2021/034174; International Filing Date May 26, 2021; dated Aug. 30, 2021 (pp. 1-10).

International Search Report and Written Opinion for International Application No. PCT/US2021/034175; International Filing Date May 26, 2021; dated Sep. 16, 2021 (pp. 1-11).

* cited by examiner

LOCKING BACKPRESSURE VALVE

BACKGROUND

In the drilling and completion industry boreholes are formed to provide access to a resource bearing formation. Occasionally, it is desirable to install a plug in the borehole in order to isolate a portion of the resource bearing formation. When it is desired to access the portion of the resource bearing formation to begin production, a drill string is installed with a bottom hole assembly including a bit or mill. The bit or mill is operated to cut through the plug. After cutting through the plug, the drill string is removed, and a production string is run downhole to begin production. Withdrawing and running-in strings including drill strings and production strings is a time consuming and costly process. The industry would be open to systems that would reduce costs and time associated with plug removal and resource production.

SUMMARY

Disclosed is a downhole tool including a tubular having an outer surface and an inner surface defining a flowbore having a longitudinal axis. A backpressure valve is arranged in the flowbore. The backpressure valve includes a flapper valve including a first side and an opposing second side pivotally mounted to the inner surface to selectively extend across the flowbore, and a locking system including a spring clip mounted to the inner surface. The flapper valve is pivotable between a first position, wherein the flapper valve is free to pivot relative to the inner surface, and a second position, wherein the flapper valve is pivoted away from the flowbore and locked open by the spring clip such that the first side forms part of the flowbore.

Also disclosed is a resource exploration and recovery system including a first system and a second system fluidically connected to the first system. The second system includes at least one tubular extending into a formation. The at least one tubular supports a downhole tool and includes an outer surface and an inner surface defining a flow path having a longitudinal axis. The downhole tool includes a backpressure valve arranged in the flowbore. The backpressure valve includes a flapper valve including a first side and an opposing second side pivotally mounted to the inner surface to selectively extend across the flowbore, and a locking system including a spring clip mounted to the inner surface. The flapper valve is pivotable between a first position, wherein the flapper valve is free to pivot relative to the housing, and a second position, wherein the flapper valve is pivoted away from the flowbore and locked open by the spring clip such that the first side forms part of the flowbore.

Further disclosed is a method of operating a backpressure valve including positioning a flapper valve in a closed configuration to prevent fluid flow through flowbore in a backpressure valve during a milling operation, pumping off a bottom hole assembly at a completion of the milling operation, introducing an object into a tubular string supporting the backpressure valve, shifting a flapper valve to a production configuration with the object, and locking the flapper valve open with a spring clip. The flapper valve forming a surface of the flowbore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
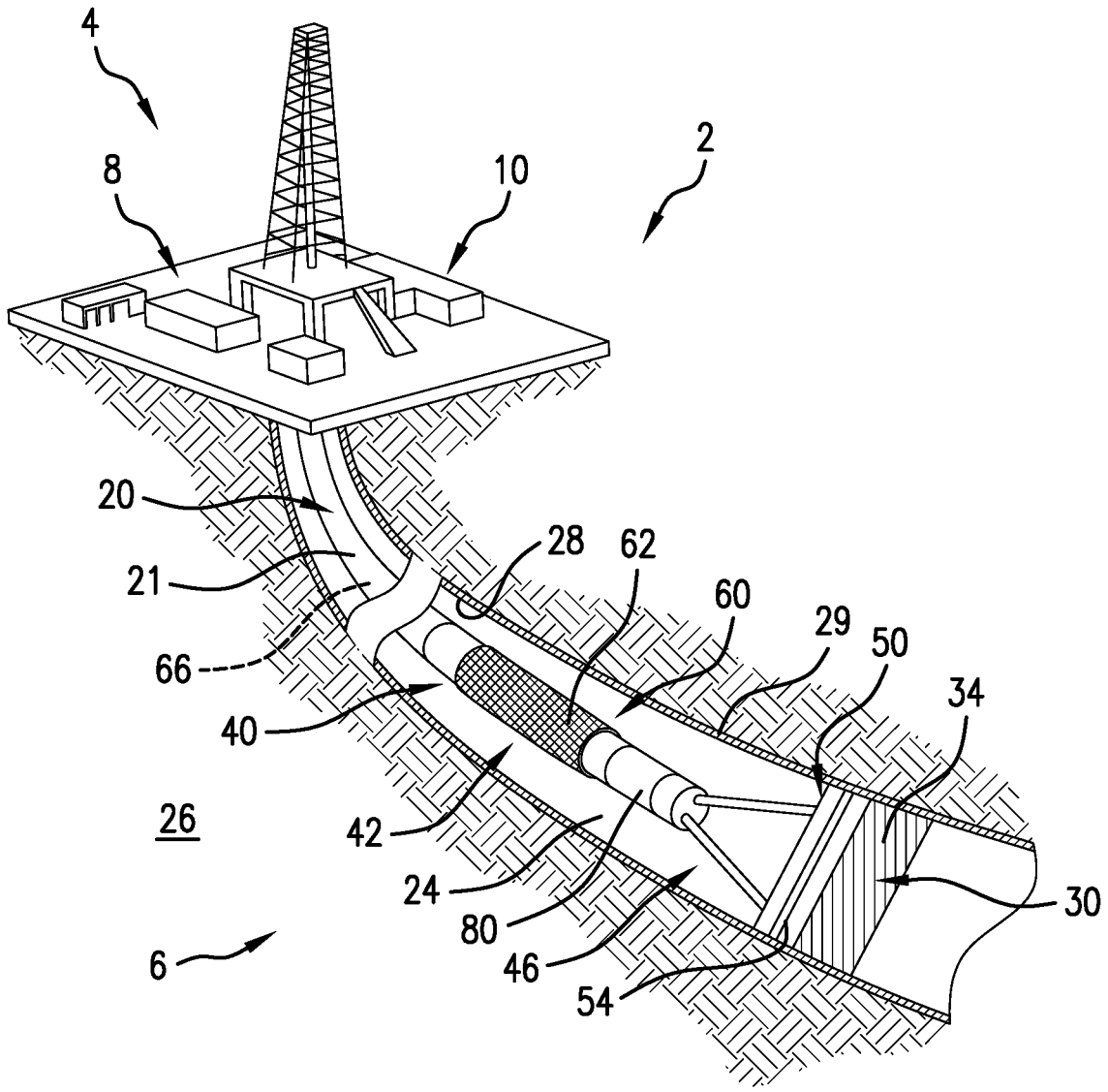
FIG. 1 depicts a resource exploration and recovery system including a locking backpressure valve, in accordance with an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a first system 4 which takes the form of a surface system operatively connected to a second system 6 which takes the form of a subsurface or subterranean system. First system 4 may include pumps 8 that aid in completion and/or extraction processes as well as fluid storage 10. Fluid storage 10 may contain a gravel pack fluid or slurry, or drilling mud (not shown) or other fluid which may be introduced into second system 6.

Second system 6 may include a downhole string 20 formed from one or more tubulars such as indicated at 21 that is extended into a wellbore 24 formed in formation 26. Wellbore 24 includes an annular wall 28 that may be defined by a wellbore casing 29 provided in wellbore 24. Of course, it is to be understood, that annular wall 28 may also be defined by formation 26. In the exemplary embodiment shown, subsurface system 6 may include a downhole zonal isolation device 30 that may form a physical barrier between one portion of wellbore 24 and another portion of wellbore 24. Downhole zonal isolation device 30 may take the form of a bridge plug 34. Of course, it is to be understood that downhole zonal isolation device 30 may take on various forms including frac plugs formed from composite materials and/or metal, sliding sleeves and the like.

In further accordance with an exemplary embodiment, downhole string 20 defines a drill string 40 including a plug removal and production system 42. Plug removal and production system 42 is arranged at a terminal end portion (not separately labeled) of drill string 40. Plug removal and production system 42 includes a bottom hole assembly (BHA) 46 having a plug removal member 50 which may take the form of a bit or a mill 54. Of course, it is to be understood that plug removal member 50 may take on various forms such as a mill or a bit. BHA 46 may take on a variety of forms known in the art.

Plug removal and production system 42 includes a selective sand screen 60 arranged uphole of BHA 46. Selective sand screen 60 includes a screen element 62 that is arranged over a plurality of openings (not shown) formed in drill string 40. It is to be understood that the number of screen elements may vary. Further, it is to be understood that screen opening size may vary. It is also to be understood that screen element 62 may include a number of screen layers. The openings in drill string 40 fluidically connect wellbore 24 with a flow path 66 extending through drill string 40.

Figure 2:
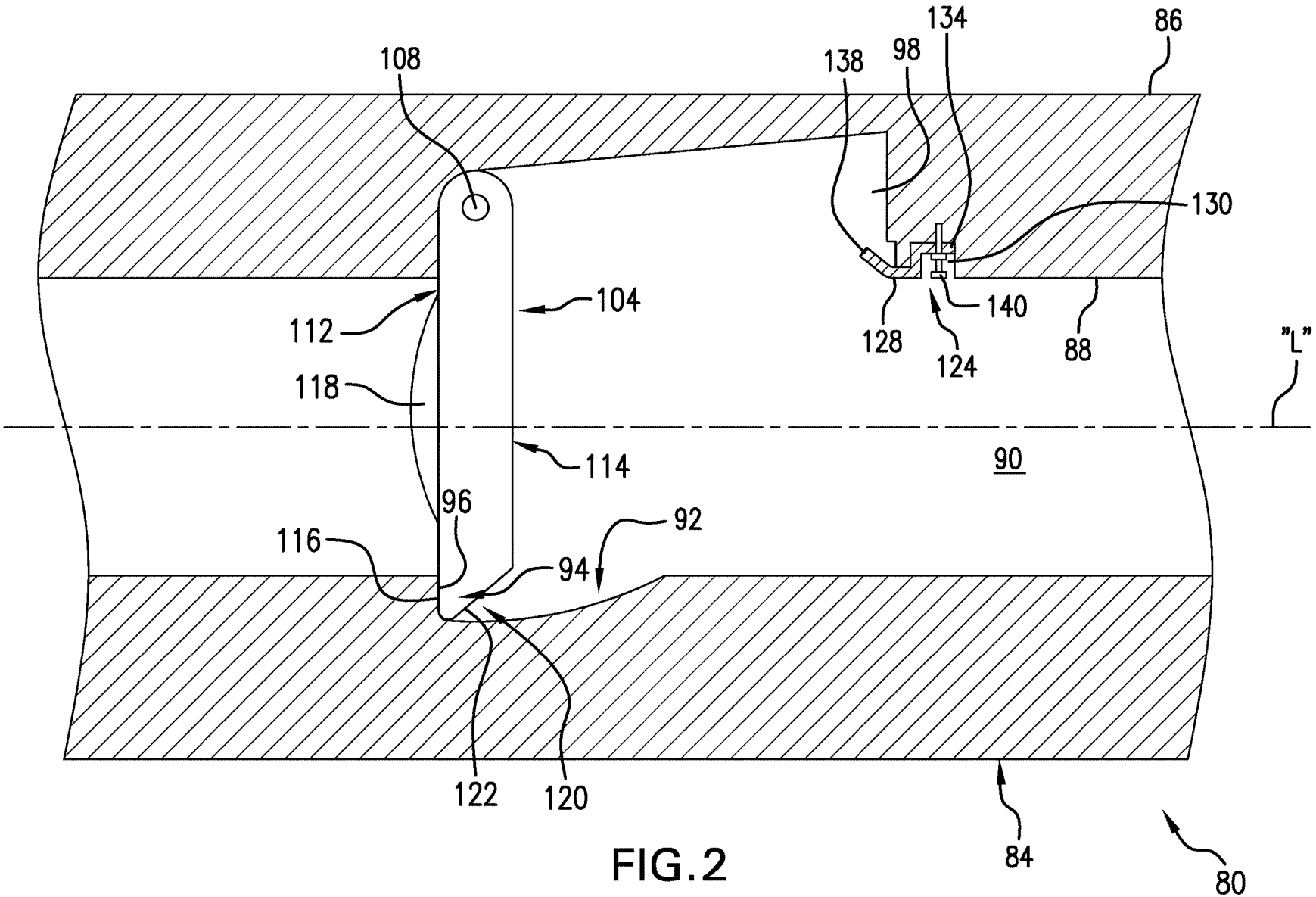
FIG. 2 depicts a cross-sectional side view of the locking backpressure valve in a run-in configuration, in accordance with an exemplary aspect.

In yet still further accordance with an exemplary embodiment, plug removal and production system 42 includes a downhole tool (not separately labeled) that may take the form of a backpressure valve (BPV) 80 arranged downhole of selective sand screen 60 and uphole of BHA 46. Referring to FIG. 2, BPV 80 includes a tubular 84 that forms part of drill string 40. Tubular 84 includes an outer surface 86 and an inner surface 88 that defines a flowbore 90 having a longitudinal axis "L" that receives BPV 80. Inner surface 88 includes a recess 92 having an annular wall 94 that is substantially perpendicular to longitudinal axis "L". Annular wall 94 defines a valve seat 96. While valve seat 96 is shown to be integrally formed with tubular 84, it should be understood that a valve seat may be provided as a separate component.

In an embodiment, recess 92 includes a valve receiving portion 98 that supports and selectively receives a flapper valve 104. Flapper valve 104 is supported by a hinge 108 arranged in valve receiving portion 98. Flapper valve 104 includes a first side 112 and an opposing second side 114. First side 112 includes a sealing surface 116 that engages with valve seat 96. First side 112 also includes a pivot nub 118. Pivot nub 118 is a generally semi-spherical protrusion extending outwardly from first side 112. Flapper valve 104 is also shown to include a terminal end 120 having an angled surface 122.

In an embodiment, BPV 80 includes a locking system 124 mounted in tubular 84. Locking system 124 includes a spring clip 128 mounted to inner surface 88. Inner surface 88 includes a recessed section 130. Spring clip 128 includes a base portion 134 mounted to inner surface 88 in recessed section 130 and a cantilevered end portion 138 that extends toward valve receiving portion 98. A fastener 140 connects base portion 134 to inner surface 88.

In accordance with an exemplary embodiment, after mill 54 opens a downhole most plug (not shown), BHA 46 may be pumped off and allowed to fall and collect at a toe (not shown) of wellbore 24. During drilling, flapper valve 104 is arranged in a first position (FIG. 2). In the first position, flapper valve 104 is free to pivot about a 90° arc within flowbore 90 between a closed configuration and an open configuration. In this manner, drilling fluids may pass downhole toward BHA 46, but pressure may not pass uphole beyond BPV 80. That is, pressure moving in an uphole direction would act against and cause flapper valve 104 to close against valve seat 96.

Figure 3:
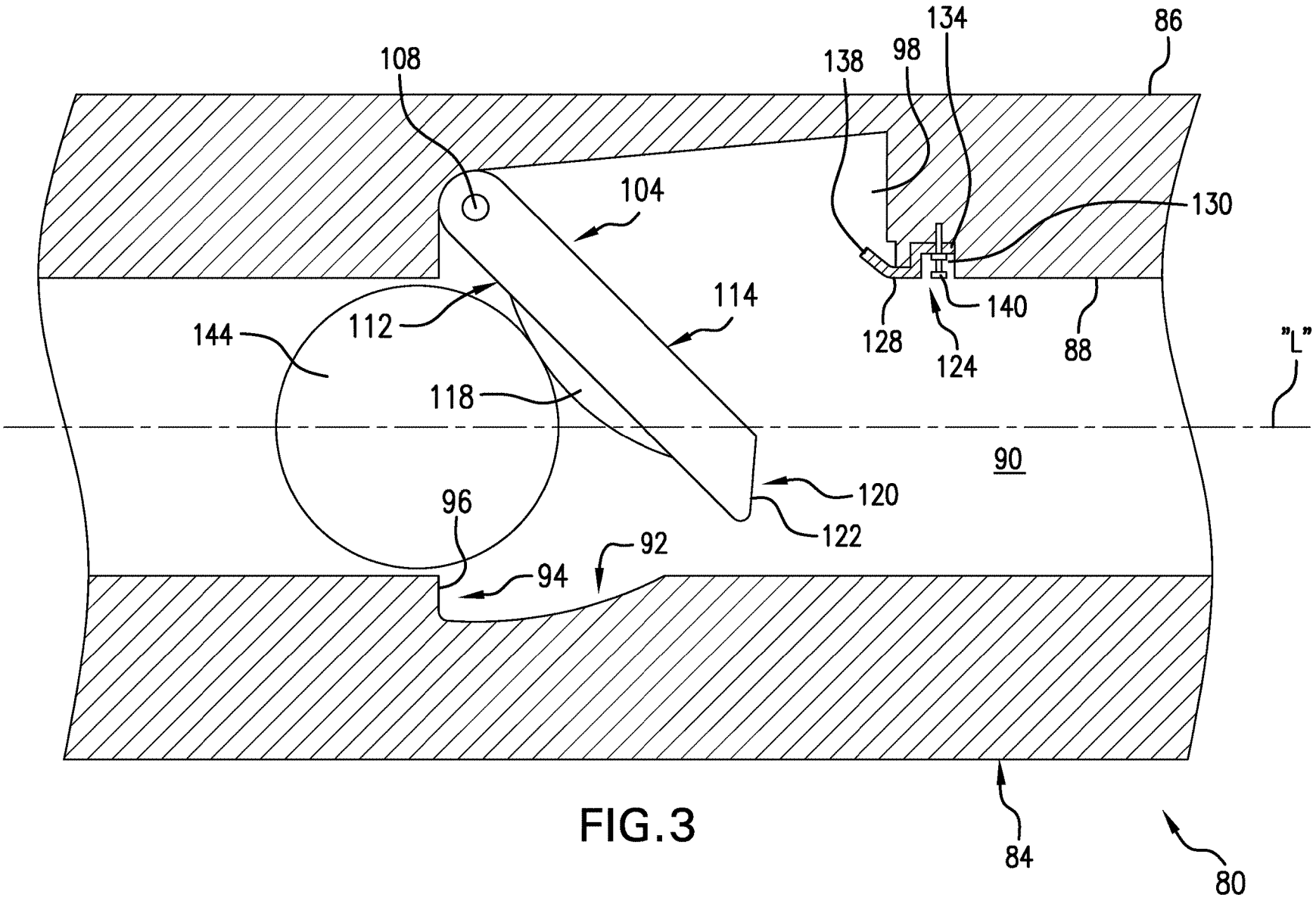
FIG. 3 depicts a cross-sectional side view of the locking backpressure valve showing an object shifting a flapper valve open.

After pumping off BHA 46, it may be desirable to produce fluids through drill string 40. As such, flapper valve 104 is moved to the second position (FIG. 4) opening flowbore 90. An object, such as a drop ball 144 may be introduced into drill string 40 and allowed to fall toward BPV 80. Drop ball 144 engages pivot nub 118 forcing flapper valve 104 toward valve receiving portion 98 of recess 92 as shown in FIG. 3. At this point it should be understood that while described as a drop ball, the object may take on various forms including balls, darts, plugs, and the like. Also, while described as employing an object to shift the flapper, other methods, such as tools, tubing pressure, tubing fluid, and the like may also be employed.

Figure 4:
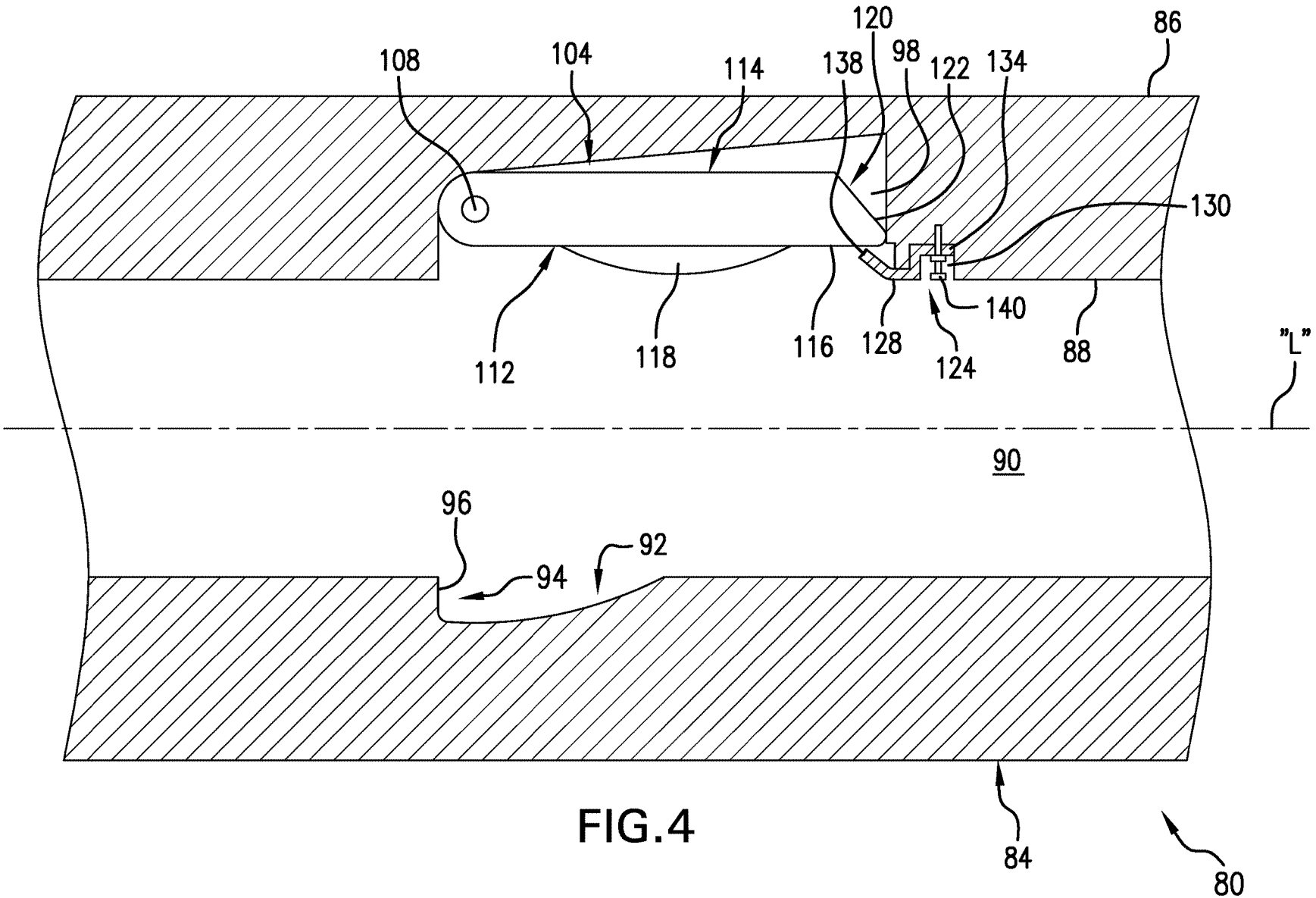
FIG. 4 depicts a cross-sectional side view of the locking backpressure valve a production configuration with the flapper valve locked open, in accordance with an exemplary aspect.

As flapper valve 104 pivots past 90° from the first position, terminal end 120 engages and deflects cantilevered end portion 138 of spring clip 128 radially outwardly. Flapper valve 104 then passes into valve receiving portion 98 of recess 92 as shown in FIG. 4 allowing cantilevered end portion 138 to spring back radially inwardly. At this point, flapper valve 104 is locked in valve receiving portion 98 of recess 92 and first side 112 forms part of flowbore 90. That is, when open, first side 112 of flapper valve 104 is exposed to fluids passing uphole. Once flapper valve 104 rotates greater than about 90° and is locked open, drop ball 144 may be allowed to pass toward the toe of wellbore 24 or to dissolve thereby opening flowbore 90. Alternatively, additional pressure may be applied causing drop ball 144 to fracture and/or pass beyond locking system 124 to open flowbore 90.

At this point it should be understood that the exemplary embodiments describe a system for actuating a backpressure valve by guiding a flapper valve into contact with a spring clip. The flapper valve moves beyond 90° from a closed or flowbore sealing configuration, past the spring clip into a recess. The spring clip prevents the flapper valve from pivoting out from the recess. Therefore, the spring clip locks the flapper valve in the recess thereby opening the flowbore to production fluids. It should be understood that while shown as including one flapper valve, the backpressure valve may include any number of valves.

Embodiment 1

A downhole tool comprising: a tubular having an outer surface and an inner surface defining a flowbore having a longitudinal axis; and a backpressure valve arranged in the flowbore, the backpressure valve including: a flapper valve including a first side and an opposing second side pivotally mounted to the inner surface to selectively extend across the flowbore; and a locking system including a spring clip mounted to the inner surface, wherein the flapper valve is pivotable between a first position, wherein the flapper valve is free to pivot relative to the inner surface, and a second position, wherein the flapper valve is pivoted away from the flowbore and locked open by the spring clip such that the first side forms part of the flowbore.

Embodiment 2

The downhole tool according to any prior embodiment, wherein the tubular includes a valve seat, wherein the first side of the flapper valve selectively seals against the valve seat.

Embodiment 3

The downhole tool according to any prior embodiment, wherein the valve seat is integrally formed with the tubular.

Embodiment 4

The downhole tool according to any prior embodiment, wherein the spring clip includes a cantilevered end portion.

Embodiment 5

The downhole tool according to any prior embodiment, wherein the tubular includes a recess, the flapper valve being mounted in the recess.

Embodiment 6

The downhole tool according to any prior embodiment, wherein the cantilevered end portion extends toward the recess.

Embodiment 7

The downhole tool according to any prior embodiment, wherein the first position is spaced from the second position along an arc that is greater than 90°.

Embodiment 8

A resource exploration and recovery system comprising: a first system; a second system fluidically connected to the first system, the second system including at least one tubular extending into a formation, the at least one tubular supporting a downhole tool and including an outer surface and an inner surface defining a flow path having a longitudinal axis, the downhole tool comprising: a backpressure valve arranged in the flowbore, the backpressure valve including: a flapper valve including a first side and an opposing second side pivotally mounted to the inner surface to selectively extend across the flowbore; and a locking system including a spring clip mounted to the inner surface, wherein the flapper valve is pivotable between a first position, wherein the flapper valve is free to pivot relative to the housing, and a second position, wherein the flapper valve is pivoted away from the flowbore and locked open by the spring clip such that the first side forms part of the flowbore.

Embodiment 9

The resource exploration and recovery system according to any prior embodiment, wherein the housing includes a valve seat, wherein the first side of the flapper valve selectively seals against the valve seat.

Embodiment 10

The resource exploration and recovery system according to any prior embodiment, wherein the valve seat is integrally formed with the at least one tubular.

Embodiment 11

The resource exploration and recovery system according to any prior embodiment, wherein the spring clip includes a cantilevered end portion.

Embodiment 12

The resource exploration and recovery system according to any prior embodiment, wherein the at least one tubular includes a recess, the flapper valve being mounted in the recess.

Embodiment 13

The resource exploration and recovery system according to any prior embodiment, wherein the cantilevered end portion extends toward the recess.

Embodiment 14

The resource exploration and recovery system according to any prior embodiment, wherein the first position is spaced from the second position along an arc that is greater than 90°.

Embodiment 15

A method of operating a backpressure valve comprising: positioning a flapper valve in a closed configuration to prevent fluid flow through flowbore in a backpressure valve during a milling operation; pumping off a bottom hole assembly at a completion of the milling operation; introducing an object into a tubular string supporting the backpressure valve; shifting a flapper valve to a production configuration with the object; and locking the flapper valve open with a spring clip, the flapper valve forming a surface of the flowbore.

Embodiment 16

The method according to any prior embodiment, wherein locking the flapper valve open includes urging the flapper valve into a recess formed in a tubular.

Embodiment 17

The method according to any prior embodiment, wherein shifting the flapper valve open with the object includes engaging a pivot nub formed on the flapper valve with a drop ball.

Embodiment 18

The method according to any prior embodiment, wherein shifting the flapper valve to the production configuration includes pivoting the flapper valve a distance greater than about 90° from the closed configuration.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a tubular having an outer surface and an inner surface defining a flowbore having a longitudinal axis, the inner surface including a recess; and a backpressure valve arranged in the flowbore, the backpressure valve including:

a flapper valve including a first side and an opposing second side pivotally mounted to the inner surface to selectively extend across the flowbore; and a locking system including a spring clip having a cantilevered end section mounted to the inner surface, wherein the flapper valve is pivotable between a first position, wherein the flapper valve is free to pivot relative to the inner surface, and a second position, wherein the flapper valve is pivoted away from the flowbore into the recess and locked open by the spring clip such that the first side forms part of the flowbore.

2. The downhole tool according to claim 1, wherein the tubular includes a valve seat, wherein the first side of the flapper valve selectively seals against the valve seat.

3. The downhole tool according to claim 2, wherein the valve seat is integrally formed with the tubular.

4. The downhole tool according to claim 1, wherein the cantilevered end portion extends toward the recess.

5. The downhole tool according to claim 1, wherein the first position is spaced from the second position along an arc that is greater than 90°.

6. A resource exploration and recovery system comprising:

a first system;

a second system fluidically connected to the first system, the second system including at least one tubular extending into a formation, the at least one tubular supporting a downhole tool and including an outer surface and an inner surface defining a flow path having a longitudinal axis, the inner surface including a recess, the downhole tool comprising:

a backpressure valve arranged in the flowbore, the backpressure valve including:

a flapper valve including a first side and an opposing second side pivotally mounted to the inner surface to selectively extend across the flowbore; and a locking system including a spring clip having a cantilevered end mounted to the inner surface, wherein the flapper valve is pivotable between a first position, wherein the flapper valve is free to pivot relative to the flowbore, and a second position, wherein the flapper valve is pivoted away from the flowbore into the recess and locked open by the spring clip such that the first side forms part of the flowbore.

7. The resource exploration and recovery system according to claim 6, wherein the housing includes a valve seat, wherein the first side of the flapper valve selectively seals against the valve seat.

8. The resource exploration and recovery system according to claim 7, wherein the valve seat is integrally formed with the at least one tubular.

9. The resource exploration and recovery system according to claim 6, wherein the cantilevered end portion extends toward the recess.

10. The resource exploration and recovery system according to claim 6, wherein the first position is spaced from the second position along an arc that is greater than 90°.

11. A method of operating a backpressure valve comprising:

positioning a flapper valve in a closed configuration to prevent fluid flow through flowbore in a backpressure valve during a milling operation;

pumping off a bottom hole assembly at a completion of the milling operation;

introducing an object into a tubular string supporting the backpressure valve;

shifting a flapper valve to a production configuration with the object; and locking the flapper valve open with a spring clip, the flapper valve forming a surface of the flowbore.

12. The method of claim 11, wherein locking the flapper valve open includes urging the flapper valve into a recess formed in a tubular.

13. The method of claim 11, wherein shifting the flapper valve open with the object includes engaging a pivot nub formed on the flapper valve with the object comprising a drop ball.

14. The method of claim 11, wherein shifting the flapper valve to the production configuration includes pivoting the flapper valve a distance greater than about 90° from the closed configuration.

* * * * *